US011273893B2

(12) United States Patent
Ambler et al.

(10) Patent No.: US 11,273,893 B2
(45) **Date of Patent: *Mar. 15, 2022**

(54) STIFFENING SHAFTS FOR MARINE ENVIRONMENTS

(71) Applicant: Rhodan Marine Systems of Florida, LLC, Sarasota, FL (US)

(72) Inventors: Lindsay Ambler, Myakka City, FL (US); Richard William Ambler, Myakka City, FL (US)

(73) Assignee: Rhodan Marine Systems of Florida, LLC, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/306,188

(22) Filed: May 3, 2021

(65) Prior Publication Data

US 2021/0253215 A1 Aug. 19, 2021

Related U.S. Application Data

(63) Continuation of application No. 16/815,290, filed on Mar. 11, 2020, now Pat. No. 11,027,813.

(Continued)

(51) Int. Cl.
*B63H 23/34* (2006.01)
*B63B 21/26* (2006.01)

(52) U.S. Cl.
CPC ..... *B63H 23/34* (2013.01); *B63B 21/26* (2013.01); *B63B 2221/22* (2013.01); *B63H 2023/344* (2013.01)

(58) Field of Classification Search
CPC ..... B63B 21/24; B63B 21/243; B63B 21/26; B63B 21/265; B63B 21/29; B63B 21/30; B63B 2221/20; B63B 2221/22; B63H 23/04; B63H 23/34; B63H 2023/342; B63H 2023/344; B63H 23/36

(Continued)

(56) References Cited

U.S. PATENT DOCUMENTS 3,099,242 A * 7/1963 Queen ..... B63H 5/1252 440/65
4,004,543 A * 1/1977 Cox ..... B63H 16/14 440/28

(Continued)

FOREIGN PATENT DOCUMENTS

SU 814721 A1 * 3/1981 ..... B25J 9/104

*Primary Examiner* — Daniel V Venne
(74) *Attorney, Agent, or Firm* — Goodwin Procter LLP

(57) ABSTRACT

Described herein are examples of stiffening shafts, which in some cases are adapted to couple to a marine vessel. An exemplary stiffening shaft can be used to extend a motor from the marine vessel or be used as a shallow water stick anchor. The exemplary stiffening shafts can include a plurality of linked vertebrae stacked to form a column and at least one inelastic tension element threaded longitudinally through the plurality of vertebrae. The shaft can have a flexible configuration when the at least one tension element is released and a stiffened linear configuration when the tension element is tensed to react to torque and bending moments. Alternatively, the stiffening shaft can be used as a shallow water stick anchor for a marine vessel by piercing the bottom of a marine environment (e.g., a sea bed, a lake bed, a river bed, etc.).

20 Claims, 15 Drawing Sheets

Related U.S. Application Data

(60) Provisional application No. 62/816,653, filed on Mar. 11, 2019.

(58) Field of Classification Search
USPC ..... 440/53, 57, 62, 63, 64, 65, 74, 83
See application file for complete search history.

(56) References Cited

U.S. PATENT DOCUMENTS 5,022,876 A * 6/1991 Etter ..... B63H 21/28 440/53
6,280,267 B1 * 8/2001 Griffith, Sr ..... B63H 20/007 440/53
6,669,516 B1 * 12/2003 Husted ..... B63H 5/165 440/6
9,271,701 B2 * 3/2016 Malkowski ..... A61B 17/3421

* cited by examiner

| Parameter Chart | | | | |
|---|---|---|---|---|
| Feature | Low Value | Nominal Value | High Value | Unit |
| Stiffening shaft weight | 1.5 | 10 | 72 | kg |
| Stiffening shaft thickness | 20 | 40 | 80 | mm |
| Stiffening shaft length | 36 | 84 | 180 | inches |
| Vertebra weight | 5 | 50 | 400 | g |
| Vertebra height | 6 | 12.7 | 25 | mm |
| Vertebra diameter | 20 | 40 | 80 | mm |
| Number of vertebrae | 36 | 240 | 720 | units |
| Compressive load threshold | 40 | 120 | 300 | kpsi |
| Tension threshold | 500 | 3000 | 20,000 | lbs |
| Zipper segment weight | 5 | 50 | 400 | g |
| Zipper segment height | 6 | 12.7 | 25 | mm |
| Zipper segment length | 20 | 40 | 80 | mm |
| Zipper segment width | 15 | 30 | 60 | mm |
| Number of zipper segments | 36 | 240 | 720 | units |
| Tension element thickness | 3 | 5 | 12 | mm |
| Tension element length | 36 | 125 | 250 | inches |
| Torque threshold magnitude | 2 | 10 | 50 | ft-lbs |
| Trolling motor weight | 5 | 10 | 20 | kg |
| Trolling motor horsepower | 0.5 | 2 | 10 | HP |

FIG. 13

STIFFENING SHAFTS FOR MARINE ENVIRONMENTS

CROSS-REFERENCE TO RELATED APPLICATION

This application is a continuation of and claims the benefit of priority to U.S. patent application Ser. No. 16/815,290 entitled "Stiffening Shafts for Marine Environments," filed on Mar. 11, 2020, which claims priority to and the benefit of U.S. Provisional Patent Application No. 62/816,653 titled "Stiffening Shafts for Marine Environments" and filed on Mar. 11, 2019, the entirety of which is incorporated herein by reference.

TECHNICAL FIELD

The following disclosure is directed to stiffening shafts and, more specifically, stiffening shafts for marine vessels.

BACKGROUND

Trolling motors employ rigid shafts that clamp to the boat hull and extend downward from the deck of the boat to position a propeller at the appropriate depth in the water. The clamped shaft is pivotable, to direct and react the thrust generated by the propeller and direct the boat in the desired direction. These rigid shafts are long (e.g., up to ten feet in length) and cumbersome to store onboard when not deployed. Existing shallow water anchor products attempt to address this issue by utilizing folding or telescoping shafts. For instance, such a product can be deployed by unfolding the foldable shaft or extending a telescoping shaft to form a more rigid shaft. However, these products have disadvantages and are not typically well-suited to mounting a motorized propeller at the distal or lower end. Additionally, a foldable shaft requires hinge mechanisms that can get in the way of fishing or other activities on a marine vessel.

SUMMARY

Disclosed herein are exemplary embodiments of a stiffening shaft adapted to be coupled to marine vessels. This disclosure will often refer to the stiffening shaft as being used with a marine vessel, but in various embodiments the stiffening shaft can be used with any suitable structure (vessel, furniture item, tent, etc.). The stiffening shaft can have at least two states, a first state in which the shaft is rigid and a second state in which the shaft is collapsed. An exemplary stiffening shaft can be coupled between a marine vessel and a motor such that the motor is controllably positioned in the water and distanced away from the marine vessel. In this use case, the rigidity of the shaft can be important for proper control of the motor (e.g., a trolling motor). A trolling motor, to operate correctly, relies on a fixed spatial position relative to the marine vessel. Thus, in some cases, it is important that the fully-deployed stiffening shaft (i.e., in a rigid state) can maintain the motor at a fixed position away from the marine vessel. Another advantage of the stiffening shaft described herein is that it can bend during deployment with the application of force exceeding a certain magnitude and/or direction. Thus, if a shaft coupled to a motor strikes an obstacle (e.g., a rock) under water, the shaft can bend to reduce damage to the shaft and/or motor. In some implementations, the shaft may be configured to sense an operating condition that is different than an expected operating condition (e.g., moving too quickly when powered by the main propulsion engine) and retract to prevent damage by the techniques as described further herein.

Another exemplary use of a stiffening shaft is in the form of a shallow water stick anchor, in which a rigid stiffening shaft can be used to anchor a marine vessel in the ground (e.g., sea bed, lake bed, river bed), e.g., in shallow water. Specifically, one end of the stiffening shaft can be coupled to the marine vessel (e.g., the bow or stern of the vessel) while the opposite end of the shaft can be sunk into the ground at a fixed position. Here, the rigidity of the shaft is also important for maintaining position of the boat relative to the fixed position in the ground.

The collapsibility of the stiffening shaft allows for the shaft to be easily stowable aboard a marine vessel with the goal of taking up less space as compared to its fully-deployed configuration. This advantage can be particularly important on smaller marine vessels having limited storage space. Moreover, a stiffening shaft can be shipped or transported in smaller containers (in its collapsed configuration) as compared to shafts that are not able to collapse (e.g., a rigid shaft). For example, a 96-inch rigid shaft coupled to a motor may need to be shipped in containers with minimum dimensions of 10 inches by 20 inches by 108 inches. In comparison, a collapsed shaft may be able to be shipped in comparatively smaller containers having dimensions of 15 inches by 15 inches by 21 inches.

The stiffening shaft 100 can be used in other applications, including many recreational activities. For example, the stiffening shaft can be coupled to a net and used for catching animals or for cleaning pools. In another example, the stiffening shaft can be used as a retractable flagpole. In yet another example, one or more stiffening shafts can be used as part of a tent (e.g., a camping tent or military tent). In another example, the stiffening shaft can be used as part of furniture (e.g., as the legs of a stiffening table or chair). In many of these instances, the stiffening shaft as described herein can enable quick and easy assembly (and/or disassembly) or deployment of the exemplary applications.

In general, in one aspect, embodiments of the disclosure feature a stiffening shaft adapted to couple to a marine vessel. The shaft may include a plurality of vertebrae stacked to form a column; and at least one inelastic tension element threaded longitudinally through the plurality of vertebrae to link the vertebrae. At least a portion of the shaft may have a flexible configuration when the at least one tension element is released and a stiffened linear configuration when the tension element is tensed to react to torque and bending moments on the shaft.

In various embodiments, when the shaft transitions from the flexible configuration to the stiffened linear configuration, a first vertebra of the plurality of vertebrae attains concentric alignment with a second vertebra of the plurality of vertebrae. In some instances, the first vertebra includes a first contoured mating surface and the second vertebra comprises a second contoured mating surface, such that, the first contoured mating surface mates with the second contoured mating surface to attain concentric alignment. Each vertebra of the plurality of vertebrae may have an annular shape. In some instances, the first contoured mating surface includes a plurality of concave surfaces arranged about a perimeter of the annular shape, and the second contoured mating surface includes a plurality of convex surfaces arranged about the perimeter of the annular shape. The concave and convex surfaces may be adapted to mate to form a joint about which the first vertebra and the second vertebra can flex. At least one joint may form a hole extending from the first contoured mating surface to the second contoured mating surface. The hole may be adapted to accept the tension element.

In some instances, the at least one tension element includes at least two tension elements, each tension element displaced from a center of the shaft. The two tension elements may be positioned diametrically opposite each other. The shaft may include a motor disposed at a distal end thereof, wherein the shaft is adapted to at least partially house a control cable coupled to the motor. The shaft may be further adapted to at least partially house a power cable adapted to couple a power source with the motor. In some instances, the stiffening shaft may include a tensioning system adapted to selectively tense the tension element to transition the shaft between the flexible configuration and the stiffened linear configuration. The tensioning system may be manually operated. The tensioning system may include a spring-loaded cam mechanism. The tensioning system may be electrically operated. The tensioning system may be hydraulically operated. In some instances, the tensioning system may be adapted to limit tension when an external force exceeding a load capacity of the shaft is applied to the shaft when the shaft is in the stiffened linear configuration. The plurality of vertebrae may include a first set of vertebrae and a second set of vertebrae, in which the first set of vertebrae separate from the second set of vertebrae. The first set and the second set may zipper together to form the stiffening shaft. A first tension element of the at least one inelastic tension element may be threaded through the first set of vertebrae and a second tension element may be threaded through the second set of vertebrae.

In general, in another aspect, embodiments of the disclosure feature a method of manufacturing a stiffening shaft. The method includes providing a plurality of vertebrae, threading at least one tension element through the plurality of vertebrae to link the vertebrae, and attaching the tension element to a tensioning system. The method may include attaching a motor to an end of a column formed by the linked vertebrae. In some instances, each vertebra of the plurality of vertebrae includes a first contoured mating surface and a second contoured mating surface, such that, the first contoured mating surface of a first vertebra mates with the second contoured mating surface to attain concentric alignment. Each vertebra of the plurality of vertebrae may have an annular shape.

In various embodiments, the first contoured mating surface includes a plurality of concave surfaces arranged about a perimeter of the annular shape, and the second contoured mating surface includes a plurality of convex surfaces arranged about the perimeter of the annular shape. The concave and convex surfaces may be adapted to mate to form a joint about which the first vertebra and the second vertebra can flex. In some instances, at least one joint forms a hole extending from the first contoured mating surface to the second contoured mating surface, wherein the hole is adapted to accept the tension element. At least one tension element may include at least two tension elements, each tension element displaced from a center of the shaft. The two tension elements may be positioned diametrically opposite each other. The plurality of vertebrae may include a first set of vertebrae and a second set of vertebrae, in which the first set of vertebrae is separate from the second set of vertebrae. The method may further include zippering the first set and the second set together to form the stiffening shaft. Threading at least one tension element through the plurality of vertebrae to link the vertebrae may comprise threading (i) a first tension element of the at least one inelastic tension element through the first set of vertebrae and (ii) a second tension element through the second set of vertebrae.

In general, in another aspect, embodiments of the disclosure feature a method of using a stiffening shaft that includes (i) a plurality of vertebrae stacked to form a column, and (ii) at least one inelastic tension element threaded longitudinally through the plurality of vertebrae to link the vertebrae. At least a portion of the shaft may have a flexible configuration when the at least one tension element is released and a stiffened linear configuration when the tension element is tensed to react to torque and bending moments on the shaft. The method may include coupling the stiffening shaft to a marine vessel, and stiffening the stiffening shaft to the stiffened linear configuration.

In various embodiments, the stiffening shaft is coupled to a motor and the method further includes energizing the motor. The method may include deploying the stiffening shaft as a stick anchor for the marine vessel. In some instances, the tension element is coupled to a tensioning system and stiffening the stiffening shaft to the stiffened linear configuration further includes activating the tensioning system to selectively tense the tension element. The tensioning system may include a spring-loaded cam mechanism adapted to tense the tension element, and activating the tensioning system includes engaging the spring-loaded cam mechanism to selectively tense the tension element. In some instances, the tensioning system is a hydraulically operated tensioning system adapted to tense the tension element, and activating the tensioning system includes activating the hydraulically operated tensioning system to selectively tense the tension element. The plurality of vertebrae may include a first set of vertebrae and a second set of vertebrae, in which the first set of vertebrae is separate from the second set of vertebrae. The stiffening of the stiffening shaft to the stiffened linear configuration may include zippering the first set and the second set together to form the stiffening shaft. A first tension element of the at least one inelastic tension element may be threaded through the first set of vertebrae and a second tension element may be threaded through the second set of vertebrae.

These and other objects, along with advantages and features of the embodiments of the present disclosure, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which:

FIG. 13 is a parameter chart listing example low, nominal, and high values of various parameters related to the stiffening shaft.

DETAILED DESCRIPTION

Figure 1A:
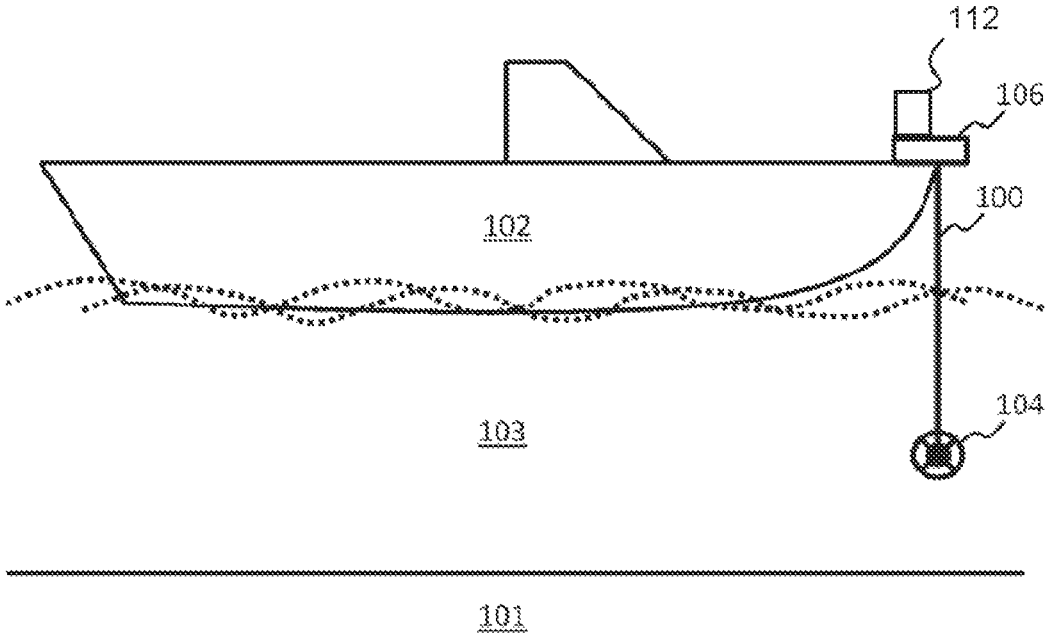
FIG. 1A is a schematic diagram of a marine vessel having a stiffening shaft coupled to a trolling motor.

Disclosed herein are exemplary embodiments of a stiffening shaft. FIG. 1A illustrates a stiffening shaft 100 coupled between a marine vessel 102 and a motor 104. The stiffening shaft 100 may be coupled to the marine vessel 102 (e.g., for use in a marine environment 103) via a coupling mechanism 106 as described further herein. Coupling mechanism 106 can be a coupling mechanism that is conventional within the art. In some implementations, the stiffening shaft can be used with a trolling motor, as part of a boat thruster system, that provides thrust for a small fishing boat or other marine vessel. Examples of boat positioning and anchoring systems can be found in U.S. Pat. No. 5,491,636, issued on Feb. 13, 1996 and titled "Anchorless boat positioning employing global positing system," and U.S. Pat. No. 6,678,589, issued on Jan. 13, 2004 and titled "Boat positioning and anchoring system," both of which are incorporated herein in their entireties. The exemplary stiffening shaft 100 can be 80 inches or greater in length (e.g., 84 inches, 90 inches, 96 inches, etc.). In an exemplary embodiment, a bow-mounted stiffening shaft 100 (as illustrated in FIG. 1A) that is coupled to a motor (e.g., a brushed DC motor, brushless DC motor, etc.) enables dynamic positioning of a vessel (e.g., a marine vessel) having a length under 50 feet.

Figure 1B:
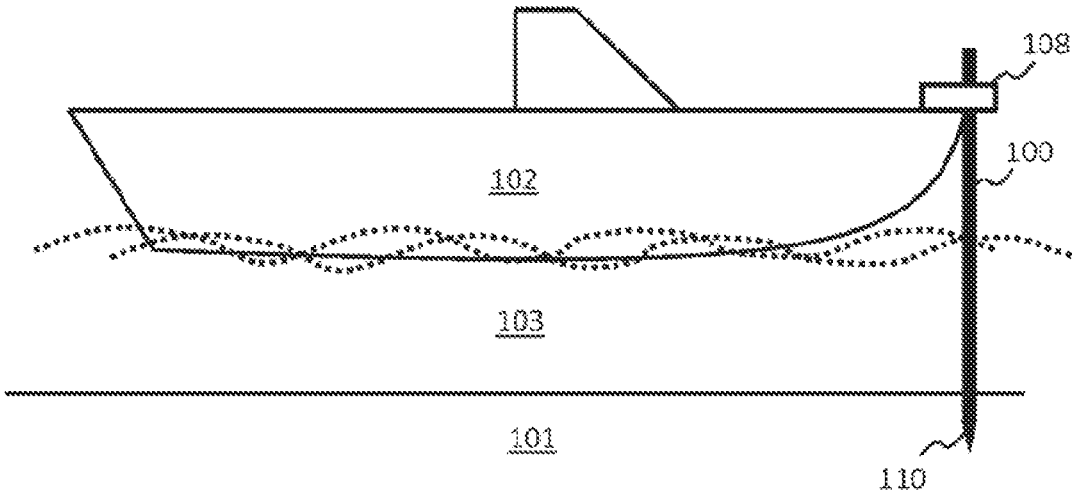
FIG. 1B is a schematic diagram of a marine vessel having a stiffening shaft functioning as a stick anchor.

FIG. 1B illustrates a stiffening shaft 100 coupled to a marine vessel 102 and purposed as a stick anchor in shallow waters. The shaft 100 may be coupled to the marine vessel 102 via a coupling mechanism 108 and may include a pointed end 110 for penetrating the ground 101 (e.g., a sea bed, a lake bed, a river bed, etc.). Coupling mechanism 108 can be a coupling mechanism that is conventional within the art.

The exemplary stiffening shaft can include a set of stacked 'vertebrae' coupled to one or more tension elements, that enable the shaft to flex for compact storage and stiffen (e.g., unfurl) into a rigid linear configuration. The stiffening of the shaft can be advantageous whether the device is used for mounting a propeller motor, shallow anchoring, or other objective, as described herein.

Exemplary Vertebrae

Figure 2A:
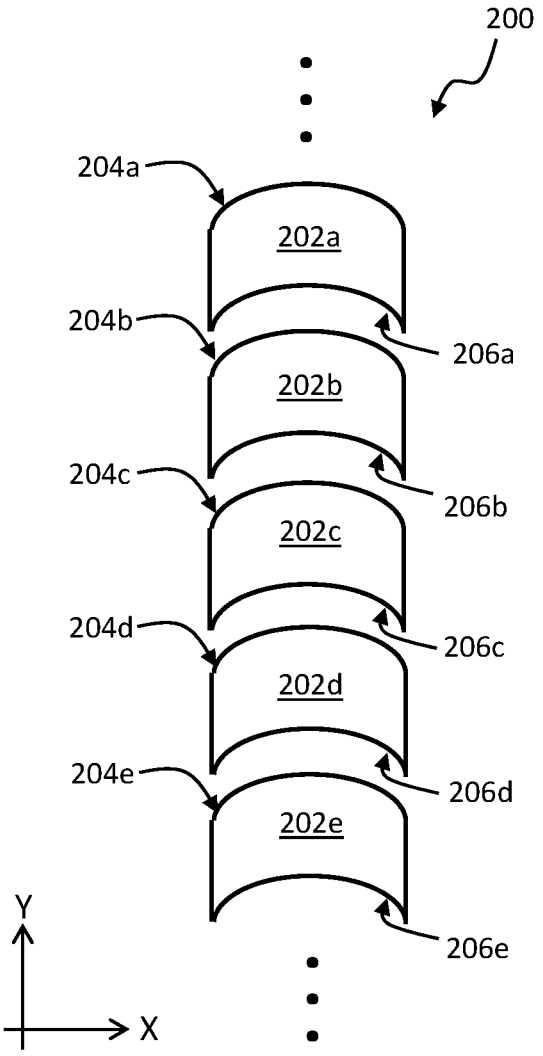
FIGS. 2A-2B are schematic diagrams of cross-sectional views of exemplary sets of vertebrae for the stiffening shaft.
Figure 2B:
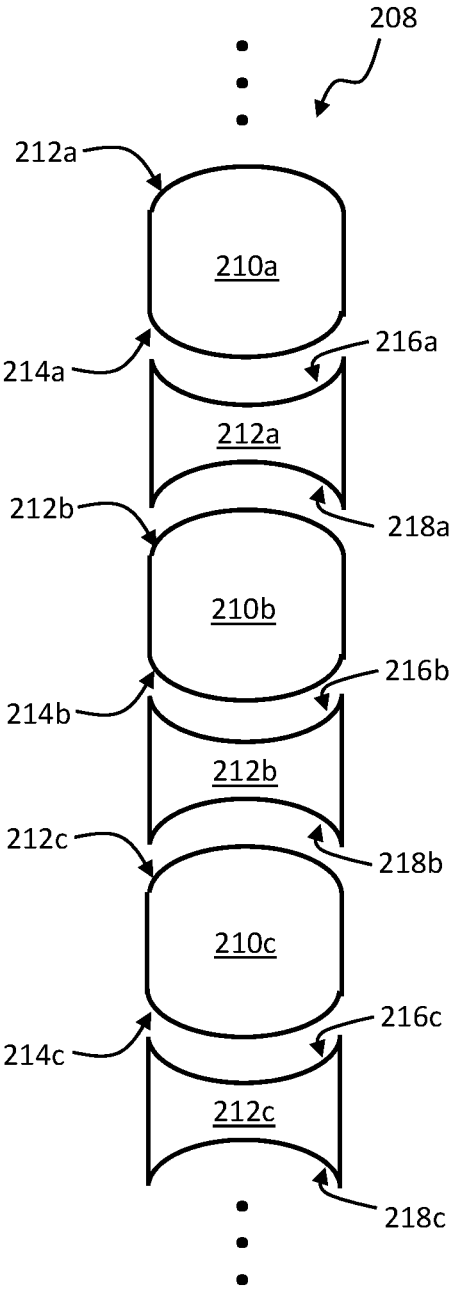

In an exemplary implementation, the stiffening shaft 100 is formed from a set of stacked vertebrae. FIGS. 2A-2B are diagrams of sets of vertebrae 200, 208 for the stiffening shaft 100. In the implementation of FIG. 2A, each vertebra 202*a*-202*e* (collectively referred to as 202) of the set of vertebrae 200 has a first mating surface 204*a*-204*e* (collectively referred to as 204), respectively, and a second mating surface 206*a*-206*e* (collectively referred to as 206), respectively. Each first mating surface 204 is configured to mate with a second mating surface 206. For example, the second mating surface 206*c* of vertebra 202*c* is adapted to mate with the first mating surface 204*d* of vertebra 202*d*.

Figure 2C:
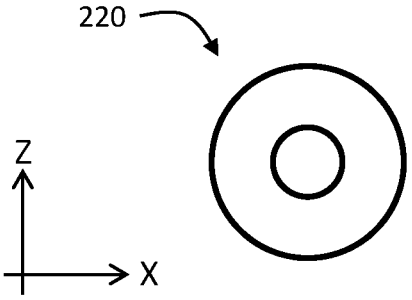
FIG. 2C is a schematic diagram of a profile of an exemplary vertebra from either set of vertebrae of FIGS. 2A-2B.

In the implementation of FIG. 2B, the set of vertebrae 208 includes two types of vertebrae. The first type of vertebra 210*a*-210*c* (collectively referred to as 210) has a first convex mating surface 212*a*-212*c* (collectively referred to as 212) and a second convex mating surface 214*a*-214*c* (collectively referred to as 214) while the second type of vertebra has a third concave mating surface 216*a*-216*c* (collectively referred to as 216) and a fourth concave mating surface 218*a*-218*c* (collectively referred to as 218). In this implementation, the second convex mating surface 214 is adapted to mate with the third concave mating surface 216 and the first convex mating surface 212 is adapted to mate with the fourth concave mating surface 218. The mating surface profiles in the above example are exemplary only. In other embodiments, the mating surfaces can have different profiles. For example, the first mating surface 212 and the second mating surface 214 can be concave and the third mating surface 216 and the fourth mating surface 218 can be convex. In some embodiments, the first mating surface 212 can be the same as, or similarly shaped to, the second mating surface 214, and the third mating surface 216 can be the same as, or similarly shaped to, the fourth mating surface 218. In general, the mating surfaces of the vertebrae can have any suitable shape or geometry. For example, the vertebrae can have a round, elliptical, rectangular, or other shaped profile. FIG. 2C is a diagram of a profile of an exemplary vertebra 220 (e.g., a vertebra from either set of vertebrae 200 or 208) having a circular profile. In some implementations, the vertebra 220 can have an annular or ring shape.

Figure 3A:
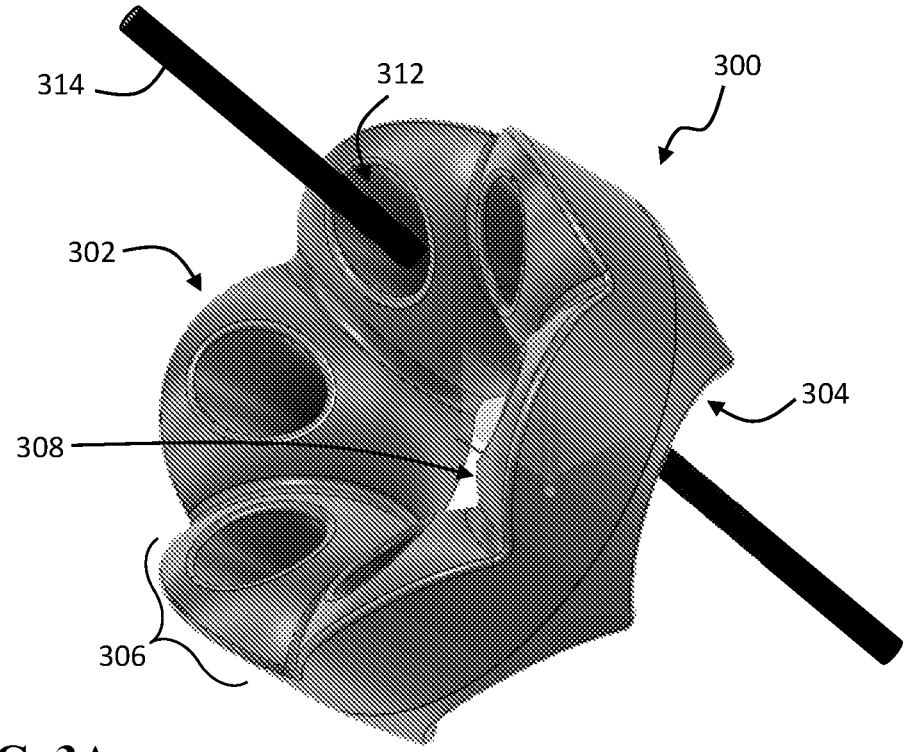
FIGS. 3A-3B are schematic bottom and top isometric views, respectively, of an exemplary vertebra of a stiffening shaft.
Figure 3B:
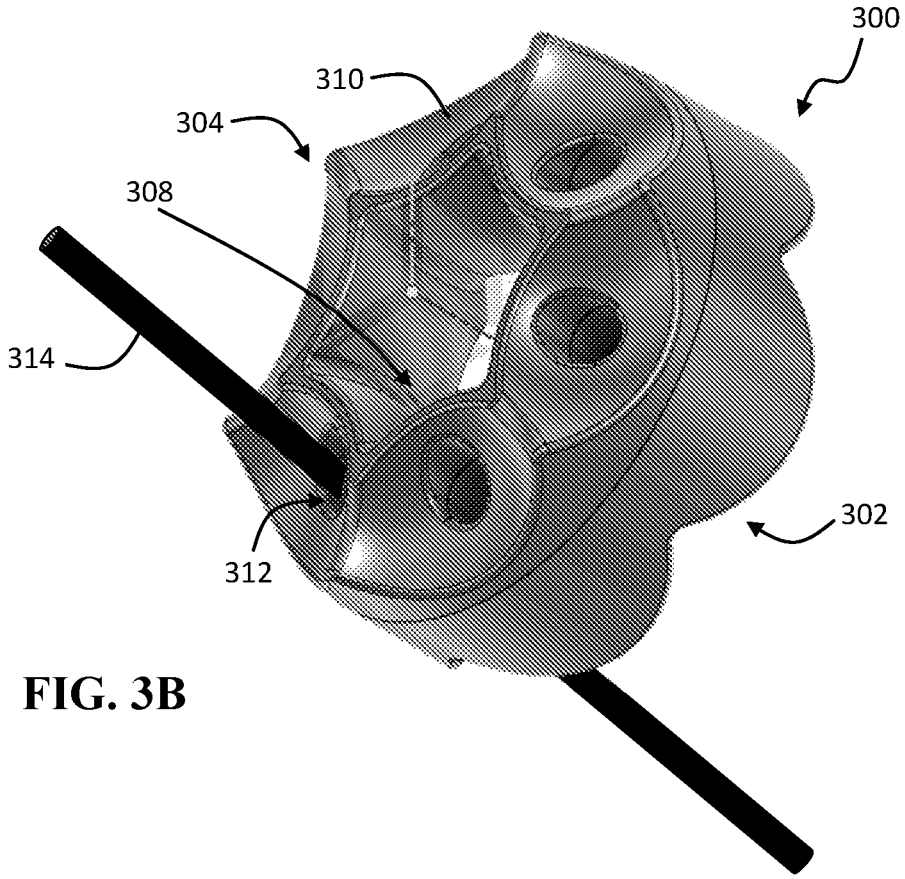

FIG. 3A is a schematic bottom isometric view of an exemplary vertebra 300 of a stiffening shaft 100 according to certain embodiments. FIG. 3B is a schematic top isometric view of the vertebra 300. Each vertebra 300 has a first contoured mating surface 302 and a second contoured mating surface 304 such that the first contoured mating surface 302 of a first vertebra can mate with the second contoured surface 304 of a second vertebra. The vertebra 300 has a circular profile so that, when two or more of a set of vertebrae 300 are concentrically aligned, the first contoured mating surface 302 of the first vertebra mates with the second contoured surface 304 of the second vertebra.

The first mating surface 302 of the vertebra 300 has a plurality of quasi-spherical convex surfaces 306 arranged around a central aperture 308 in the center of the annular vertebra 300. In other words, the convex surfaces 306 are arranged about the perimeter of the annular shape of the vertebra 300. The second mating surface 304 of the vertebra 300 has a plurality of quasi-spherical concave surfaces 310 arranged around the central aperture 308 about the perimeter of the annular shape of the vertebra 300. In this non-limiting example, the first mating surface 302 has six (6) convex surfaces 306 and the second mating surface 304 has six (6) concave surfaces 310. In other implementations, the mating surfaces 302 and 304 may have two or more convex surfaces 306 and two or more concave surfaces 310, respectively. In these specific implementations, the number of convex surfaces 306 on the first mating surface 302 matches the number of concave surfaces 310 on the second mating surface 304. These convex surfaces 306 are adapted to mate with the concave surfaces such that each corresponding pair of convex surface 306 and concave surface 310 form a joint (e.g., joint 402 in FIG. 4A), which can serve as a pivot point about which a first vertebra 300*a* and a second vertebra 300*b* flex, as described further with reference to FIGS. 4A-4B below. The quasi-spherical surface shape is only one example surface shape. In general, the surfaces can have any suitable shape.

Figure 4A:
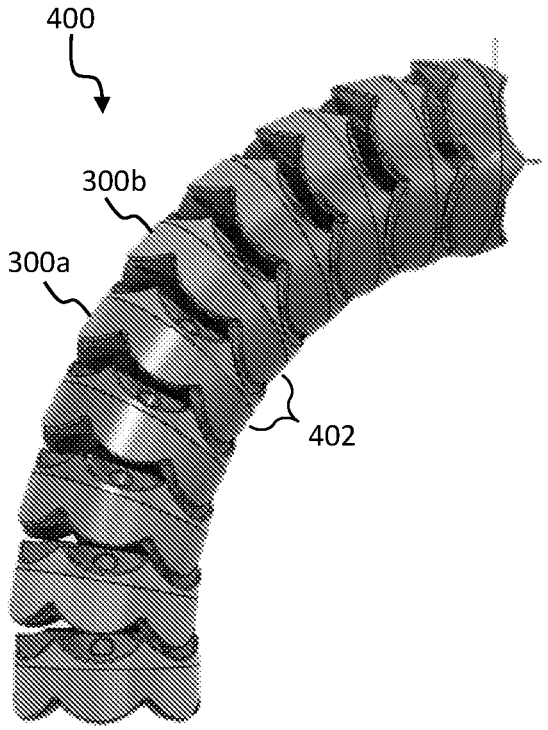
FIGS. 4A-4B are schematic side views of an exemplary set of assembled vertebrae in a flexed position.
Figure 4B:
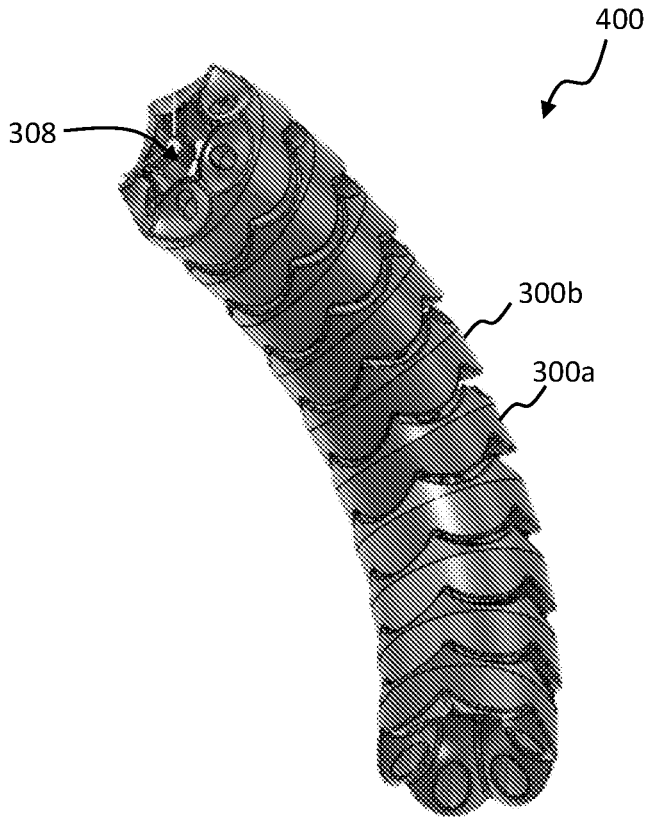

FIGS. 4A-4B illustrate multiple vertebrae stacked to form a portion of a flexible shaft 400. The exemplary shaft 400 can include any suitable number of vertebra stacked to form a column, e.g., at least 10 vertebra, at least 20 vertebra, at least 40 vertebra, or at least 50 vertebrae. In some implementations, the maximum number of vertebrae in the shaft can be 250, 300, or more. As described above, each vertebra can pivot relative to an adjacent vertebra about a pivot point formed by the convex surface 306 and concave surface 310 of neighboring vertebrae. For example, neighboring vertebrae 300*a* and 300*b* can flex at joint 402. In some implementations, a spacer may be utilized between neighboring vertebrae.

Figure 8A:
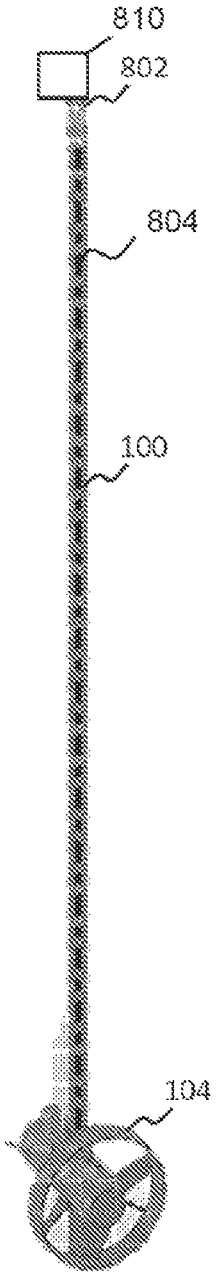
FIG. 8A is a schematic front isometric view of an exemplary stiffening shaft in a rigid, vertical position.
Figure 8B:
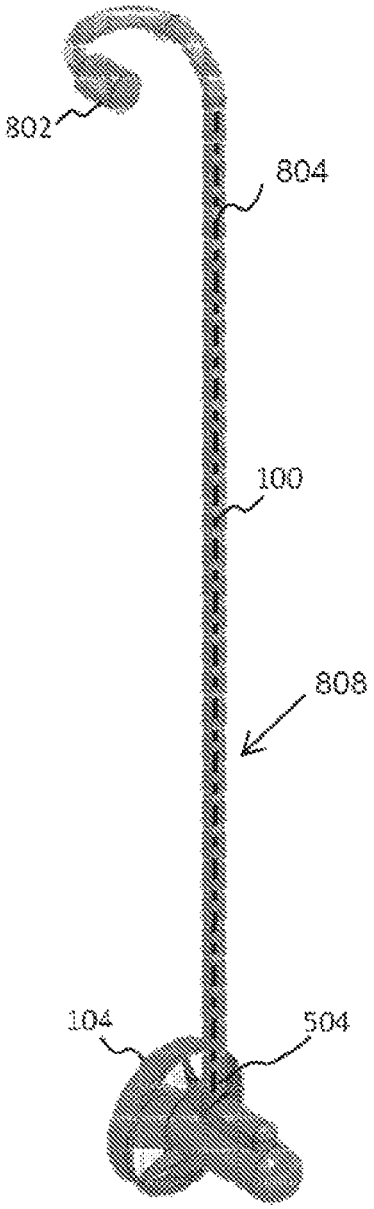
FIG. 8B is a schematic back isometric view of the exemplary stiffening shaft shown in FIG. 8A.

In some implementations, each vertebra 300 includes a central aperture 308 that extends from the first mating surface 302 to the second mating surface 304 and is adapted to provide a path for one or more cables 804 carrying power and/or data (e.g., communication, control, etc.). Multiple vertebrae 300 are stacked such the path runs from a first one of the vertebrae 300 through each subsequent vertebra. The cable(s) 804 are adapted to carry power and/or data from a first end 802 of the stiffening shaft 100 to a motor 104 disposed at the second opposing end 504 of the stiffening shaft, as is depicted in FIGS. 8A-8B. The first end of the stiffening shaft 100 may be coupled to the marine vessel 102, to a coupling mechanism 106 (between the stiffening shaft 100 and the vessel 102), and/or to another device (e.g., a controller for controlling the motor or a power source 112 for providing power to the motor). In some embodiments, the controller and/or power source 112 are coupled to the power and/or data cable, respectively. In various embodiments, the controller and/or power source 112 may be part of the coupling mechanism 106, separate from the coupling mechanism 106, aboard the vessel 102, and/or directly attached to the shaft 100. Power source 112 can be a power source that is conventional within the art.

In general, the vertebra can have any suitable dimensions and properties. In some embodiments, each vertebrae can have a diameter between 20 mm and 150 mm. In some embodiments, each vertebrae can have a maximum diameter between 80 mm and 100 mm. In a non-limiting example, each vertebra has a diameter of approximately 40 mm with a height of approximately 12.7 mm (also referred to herein as "type-A" vertebrae). Each exemplary type-A vertebrae has six quasi-spherical mating surfaces distributed around the perimeter of one side of the vertebra such that the center of each of the quasi-spherical mating surfaces are approximately 13 mm from the center of vertebra (e.g., measured from the center of the diameter). The type-A vertebrae can be configured to withstand high compressive loads of >150 kpsi. In this example, each tension cable (also referred to herein as "type-A" tension cables) is configured to be tensed to a force of approximately 3,000 lbs. The compressive force of the exemplary stiffening shaft having type-A vertebrae and type-A tension cables yields a shaft breakaway moment of approximately 1100 ft-lbs.

In some implementations, the vertebrae are made primarily from aluminum oxide (also referred to as aluminium oxide, alumina, aloxide, aloxite, alundrum, or corundum). The use of aluminum oxide in forming the vertebrae can help prevent corrosion of the vertebrae in aqueous environments (e.g., fresh water or salt water environments). The use of aluminum oxide can be beneficial due to the amount of force it can withstand. In other words, a shaft 100 employing aluminum oxide vertebrae can withstand greater thrust levels from the motor 104 than a shaft having vertebrae made from, for example, injection-molded plastic, which may require that the size of the vertebrae be increased to withstand the same levels of thrust.

In some embodiments, the vertebrae may be made with any suitable metal, metal alloy, plastic, or other hard material (e.g., injection-molded plastic, aluminum, stainless steel, etc.). Balancing various performance and/or environmental factors can dictate the selection of the appropriate material. For instance, the low compressive strength of plastics may significantly increase the size of the vertebra needed to support the target loads. Vertebrae made primarily from aluminum may be at risk of corrosion issues and, notably, the sliding action of the spherical joints may make it difficult to maintain corrosion resistant coatings, such as anodizing. Vertebrae made primarily from stainless steel may be able to handle the compressive loads and avoid corrosion issues, but the weight of stainless steel vertebrae may be too great for deployment.

In some implementations, the stacked vertebrae may be disposed in a flexible protective cover or sheath to protect the vertebrae from debris or foreign objects.

Exemplary Tensioning Systems

Referring to FIGS. 3A-3B, in some implementations, each of the vertebrae may have at least one tensioning aperture 312 extending from the first mating surface 302 to the second mating surface 304 and adapted to provide a path for a tension element 314 (e.g., cable, chain, rope, wire, etc.). In some embodiments, the vertebrae have two or more holes 312 through which a corresponding number of tension elements 314 are threaded. In general, any suitable number of holes 312 and tension elements 314 can be used. The exemplary vertebra 300 has six (6) tensioning apertures 312 through which six (6) tension cables 314 (not all shown) are threaded. In some embodiments, the tension cable(s) 314 are made primarily from ultra-high-molecular-weight polyethylene (UHMWPE) (also known as high-modulus polyethylene (HMPE)) formed into fiber (e.g., under commercial brands Dyneema® by Royal DSM N.V. or Spectra® by Honeywell International Inc.).

Figure 7:
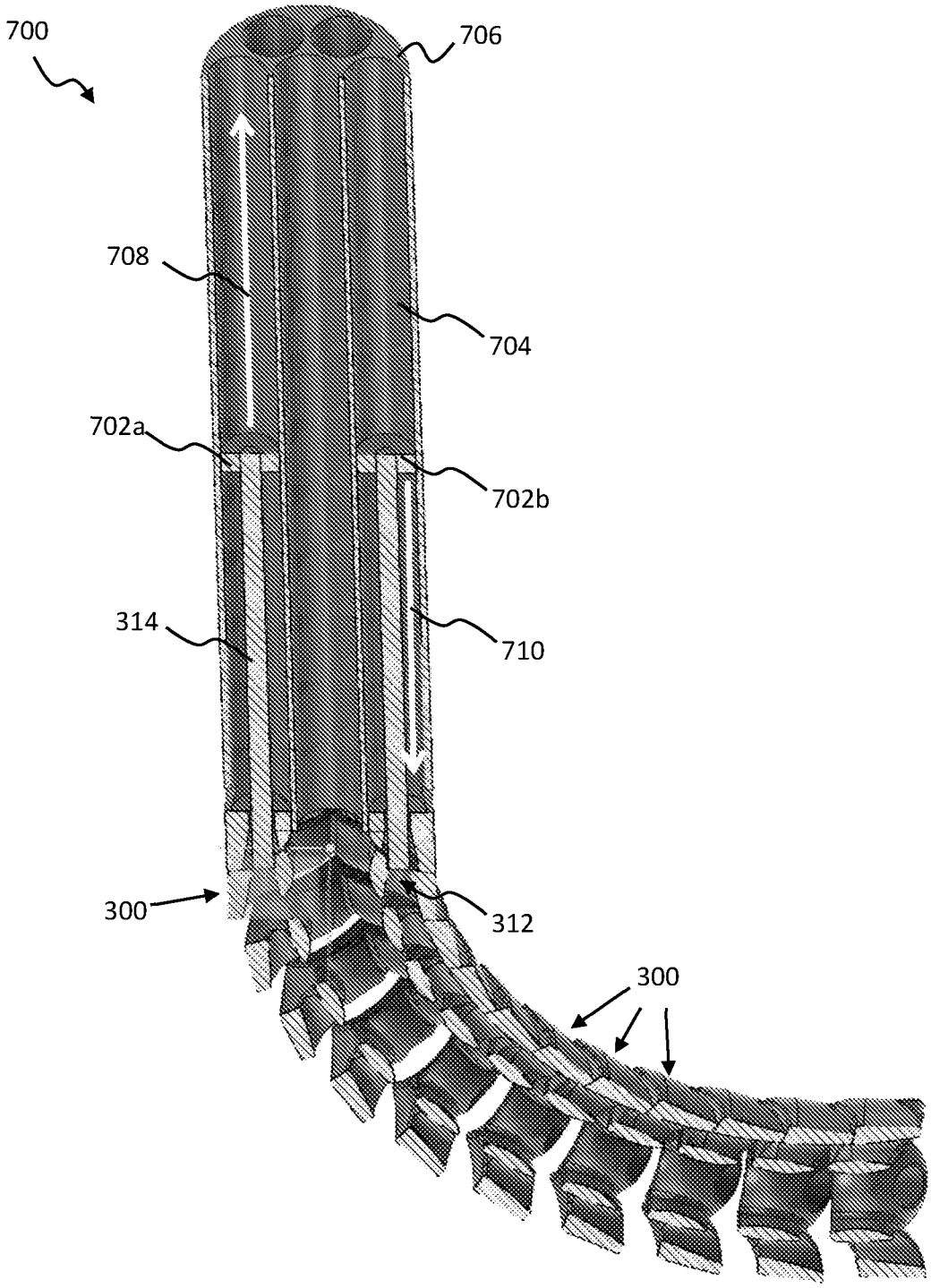
FIG. 7 is a schematic cross-sectional view of an exemplary tensioning system for a stiffening shaft.
Figure 9A:
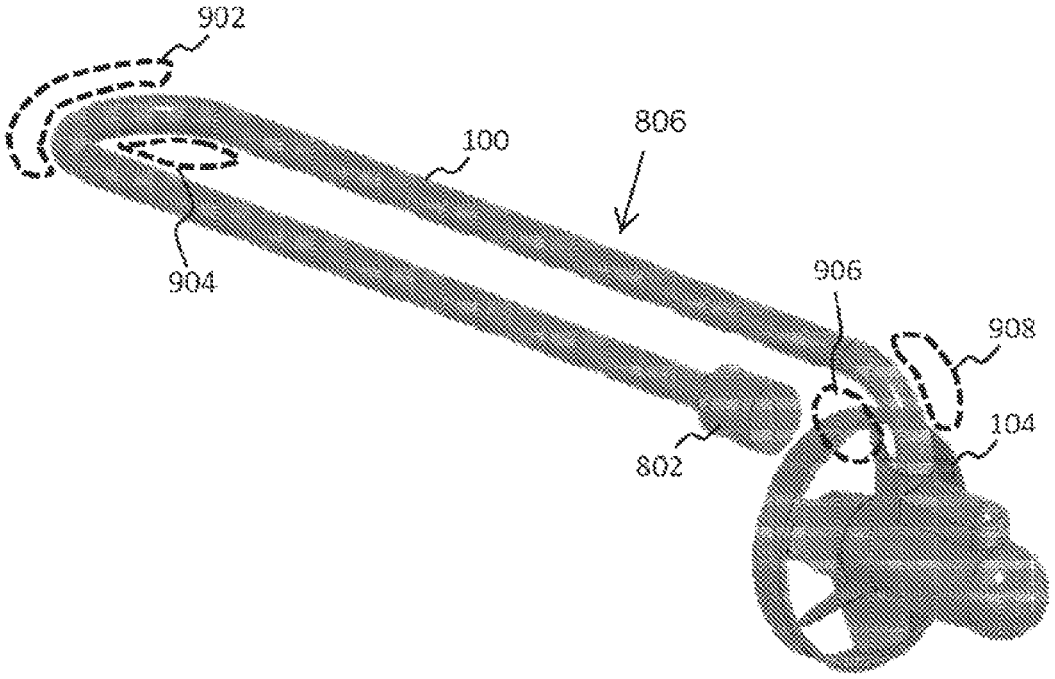
FIG. 9A is a schematic isometric view of an exemplary stiffening shaft in a folded configuration.

The tension element(s) can provide a mechanism by which the shaft 100 collapses and/or stiffens. When the tension element(s) 314 are released, the shaft 100 is caused to collapse into a flexible configuration 806 (see FIG. 9A). When the tension element(s) are tensed, the shaft 100 can be stiffened into a stiffened linear configuration 808 (see FIG. 8B). In FIGS. 8B and 9A, for example, the shaft 100 is schematically depicted as a solid structure; however, FIGS. 4A-4B and 7 show the vertebrae structure in various stages of stiffening. A shaft 100 in the stiffened linear configuration 808 can react to torque and bending moments. In some cases, the tensioning apertures 312 are each positioned at the semi-spherical joints created by the concave surface 310 and the corresponding convex surface 306. The semi-spherical joints can be configured to provide alignment and torsional stability when the vertebrae 300 attain concentric alignment. The joints can further carry compressive loads when opposing cables are tensioned to form a rigid shaft that reacts bending forces and torsional moments. In some embodiments, the tension in the stiffening shaft 100 can be configured such that the shaft 100 can bend if the shaft 100 or motor 104 strikes an object, such as a rock, submerged log, etc. The bending of the shaft 100 can be controlled by determining the tension force of the tension element(s) 314 within the stiffening shaft 100.

In some embodiments, the stiffening shaft 100 is only controllable when the shaft is fully deployed (i.e., in a rigid position). Exemplary types of control of the shaft 100 can include one or more of: (i) operational control of the motor 104 coupled to the stiffening shaft 100; (ii) rotational control of the shaft 100; (iii) displacement of the shaft 100; (iv) retraction of the shaft 100; or (v) deployment of the shaft 100. For example, a shaft 100 having power and/or data cable(s) coupled to the motor 104 may only enable signals (e.g., for steering and/or propulsion) from a first end of the shaft 100 to reach the motor 104 at the second end of the shaft 100 when the shaft 100 is deployed or rigid. As discussed further below, deployment of the shaft can include generating a fully rigid or a partially rigid shaft 100. If the shaft is bent (e.g., due to an obstruction), the motor may not receive power and/or data via the cable(s) in the shaft. In some embodiments, the shaft 100 can include a sensor configured to sense a deformation (e.g., bending, twisting, etc.) in the stiffening shaft 100. In some embodiments, the sensor can be configured to detect an overload condition (e.g., excessive pressure, movement of the tension cables, relief valve actuation, etc.). The sensor can transmit a signal to a controller coupled to the power and/or data cable(s) such that the cable(s) can cease transmitting power and/or data to the motor 104 when the deformation occurs. In some embodiments, the sensor may be positioned at one of the ends of the shaft 100. For instance, the sensor can be disposed in or near the coupling mechanism 106 or the motor 104.

One or more techniques may be used in tensioning and/or releasing tension in ("de-tensioning") the tension element(s) 314. The element(s) 314 may be selectively tensioned and/or de-tensioned individually or in groups of elements. In some embodiments, all tension elements(s) 314 in a stiffening shaft 100 may be tensioned and/or de-tensioned together. In other embodiments, some or all of the tension element(s) 314 in the stiffening shaft 100 may be tensioned and/or de-tensioned at different times. The tensioning system may be included as part of the coupling mechanism 106 or may be entirely separate. In some embodiments, the tensioning system may be manually operated (e.g., by a user of the stiffening shaft) or automatically operated (e.g., by a signal sent to a controller coupled to the tensioning system). For instance, during normal operation, the controller can be configured to send one or more control signals to release or reduce tension in the cables in conjunction with extending or retracting the shaft. Then, the controller can re-tension the cables if the unit is to remain in the deployed or partially deployed state. In some embodiments, a manual or automatic release mechanism can be used to de-tension the stiffening shaft in the event of failure or loss of power.

In some embodiments, the tensioning system can include a linear actuator (e.g., a screw actuator, cam actuator, wheel and axle actuator, etc.). For example, a cam actuator (e.g., cam actuator 810) or a ball screw actuator can be used to tense or compress a spring to create, maintain, and/or release tension in the tension element(s) 314. In an exemplary embodiment, the actuator may control the tension in a spring for each tension element 314. In some embodiments, the tension element(s) 314 can be tensioned and/or de-tensioned by an electromechanical actuator (e.g., a linear motor actuator). In some embodiments, the tensioning system can include one or more torque limiting clutches to prevent the tensioning element(s) 314 from breaking from an overload condition.

In some embodiments, the tension element(s) can be electrically and/or hydraulically tensioned and/or de-tensioned by a tensioning system. In an exemplary embodiment, an electrohydraulic tensioning system can control the amount or degree of tension in the tension element(s) such that the shaft can give way at a predetermined maximum load. This can reduce the likelihood that the stiffening shaft breaks or is damaged from impact. For example, this can be particularly beneficial for enabling the stiffening shaft 100 to bend upon striking an object underwater that exceeds the load carrying capacity of the shaft 100. In an exemplary embodiment, the electrohydraulic tensioning system includes a pressure relief valve to enable the shaft to be deployed at different lengths (e.g., at lengths less than then maximum length of the shaft). In one embodiment, the driving piston of the hydraulic system can be actuated by a rotary electric motor. In another embodiment, the driving piston can be actuated as part of the linear motor assembly. In some embodiments, the electrically and/or hydraulically operated tensioning system can be activated by a remote controller. For example, the remote controller may send a control signal to the tensioning system to selectively tense one or more tensioning elements.

Figure 5:
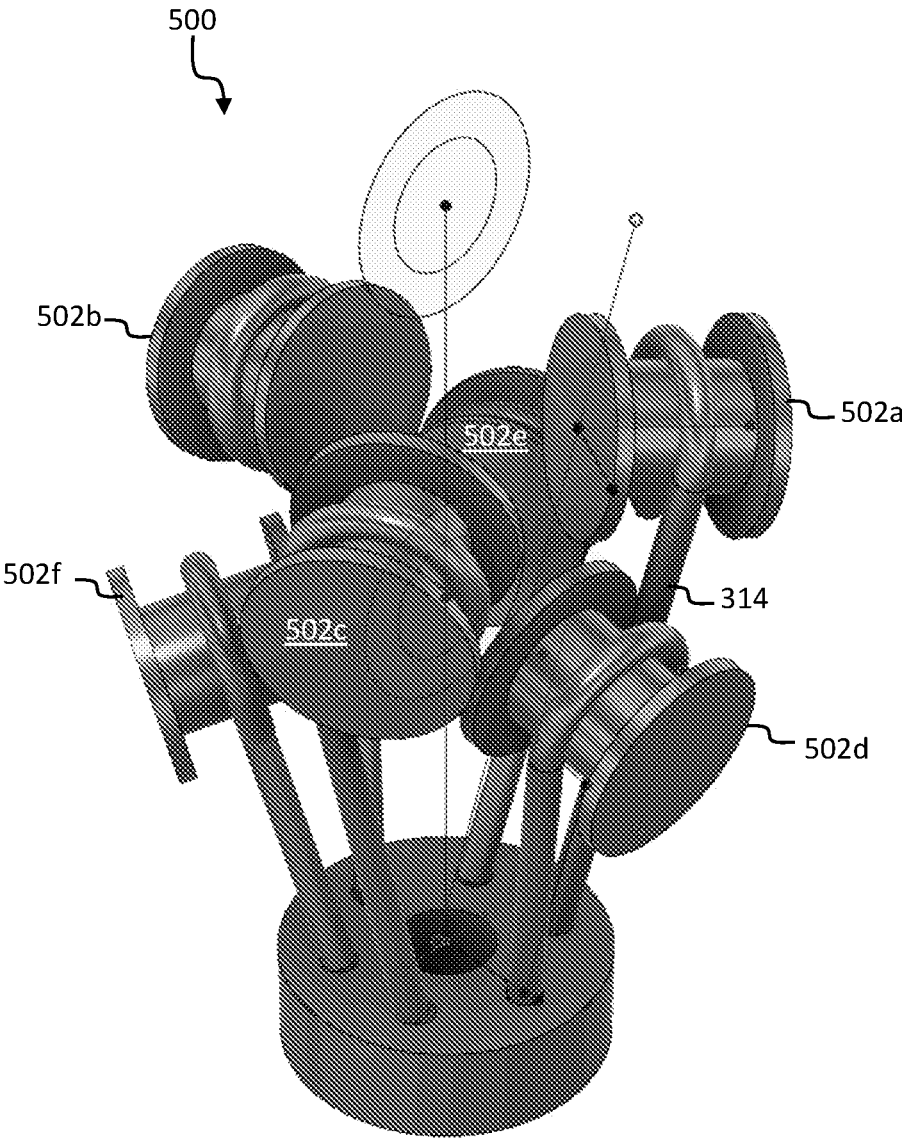
FIG. 5 is a schematic isometric view of an exemplary tensioning system for a stiffening shaft.

FIGS. 5-7 illustrate various tensioning systems for the stiffening shaft. Note that any of the tensioning systems described herein can be tensioned and/or de-tensioned by any one or more of the tensioning techniques described herein (e.g., linear actuator, electrically, hydraulically, etc.). In some embodiments, it is beneficial to tension each tensioning cable 314 such that cables 314 are uniformly tensioned. In some cases, the tensioning systems are configured to allow 'slippage' or reduction in the tension in case the tension exceeds a threshold (e.g., a threshold determined by the maximum or near maximum tension a tensioning cable 314 can withstand).

FIG. 5 features an exemplary tensioning system 500 having a winch drum 502*a*, 502*b*, 502*c*, 502*d*, 502*e*, and/or 502*f* (collectively referred to as 502) coupled at an end of each tensioning cable 314 to tension and/or de-tension the cable 314. The tensioning cable(s) 314 are tensioned when wound about the drum(s) 502 in a first direction and are de-tensioned when wound off of the drum(s) 502 in an opposite direction. Each winch drum 502 may have torque limiting clutch to protect the system from an overload condition, for example, by limiting the torque by slipping. In the specific example in FIG. 5, six tensioning cables 314 are respectively coupled to six drums 502. The six drums are arranged such that three of the drums 502*a*-502*c* are positioned above the other three drums 502*d*-502*f* This arrangement has the benefit of reducing the space taken up by the drums near the end of the tensioning cables 314, as compared to all drums arranged at the same level.

Figure 6A:
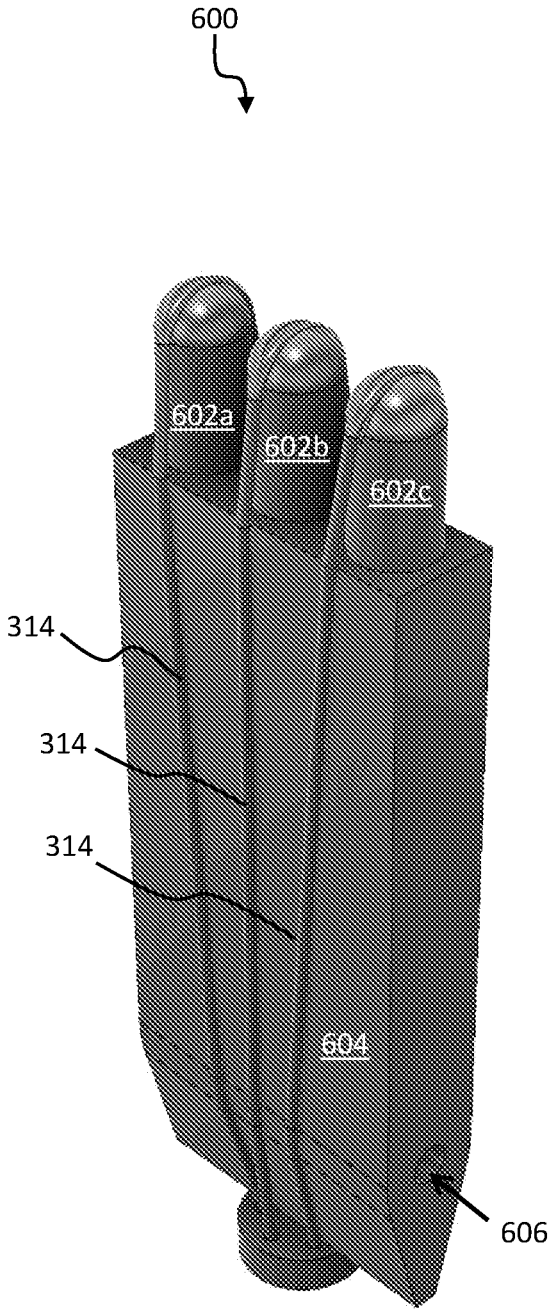
FIG. 6A is a schematic isometric view of an exemplary tensioning system for a stiffening shaft.
Figure 6B:
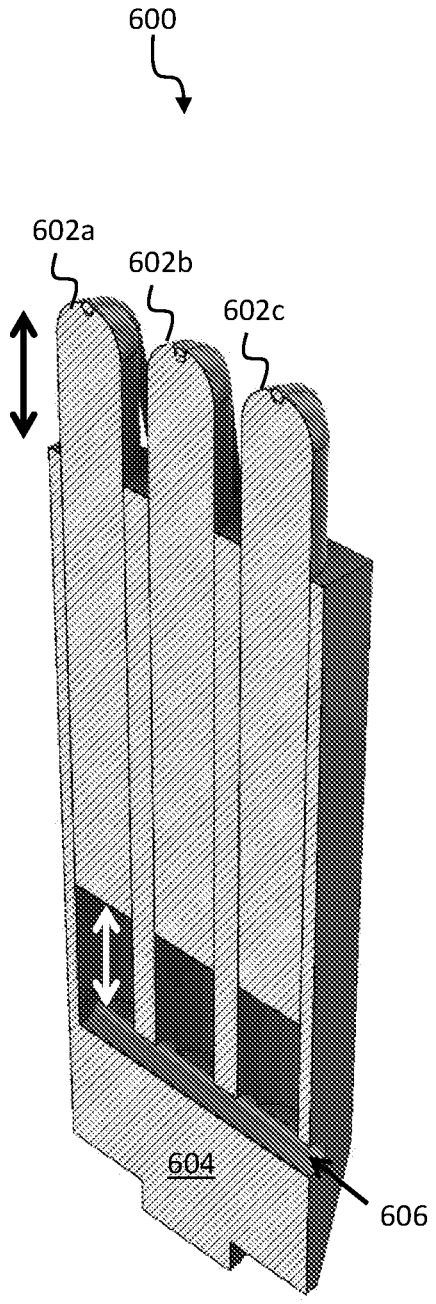
FIG. 6B is a schematic cross-sectional view of the exemplary tensioning system of FIG. 6A.

FIGS. 6A-6B illustrates another exemplary tensioning system 600 having one or more pistons for tensioning the tension elements 314. Specifically, the system 600 includes three pistons 602*a*, 602*b*, 602*c* (collectively referred to as 602) contained in respective channels in block 604. The pistons 602 can be actuated using any known technique, e.g., delivering or removing air or liquid to or from hole 606. The tension elements 314 are tensioned when the pistons 602 move up and are de-tensioned when the pistons 604 move down in block 604. In the specific example provided in FIGS. 6A-6B, the six tension elements 314 are tensioned and/or de-tensioned by three pistons 602. However, tension elements 314 can be coupled to any number of pistons (e.g., two cables per piston, three cables per piston, etc.) In other examples, each tensioning cable 314 may be coupled to an individual piston 602. In yet another example, all the tensioning cables 314 may be coupled to a single piston 602.

FIG. 7 illustrates yet another exemplary tensioning system 700 having one or more pistons 702*a*, 702*b* (collectively referred to as 702) for tensioning cables 314. In this example, the system includes a piston 702 for each tension cable 314. The pistons 702 are each contained in channels 704 of a block 706. In this example, each opening of channels 704 is concentric with the tensioning aperture 312 of vertebrae 300. The tensioning cable(s) 314 are tensioned when the piston(s) 702 are displaced up (denoted by line 708) in the channel 704 and are de-tensioned when the piston(s) 702 displaced down (denoted by line 710) in the channel 704.

In another embodiment, the vertebrae 300 of the stiffening shaft 100 are coupled to one or more conduits that become rigid when internal pressure is applied, thus causing the stiffening of the stiffening shaft 100.

FIGS. 8A-8B illustrate front and back isometric views, respectively, of the stiffening shaft 100 coupled to a motor 104. For simplicity, FIGS. 8A-8B do not show the detail of each vertebra that make up the stiffening shaft 100. In FIG. 8A, the stiffening shaft 100 is fully deployed (e.g., unfurled) in a vertical, rigid configuration. This vertical, rigid configuration can be enabled by the tensioning systems (e.g., cam actuator 810) described herein. A fully deployed shaft 100 can be used to provide a rigid support for the motor 104 in the water, for example, so that the motor can provide a trolling and/or thrusting function for the vessel 102 coupled thereto. In stick anchor applications, the fully deployed shaft 100 can provide the same or similar rigidity as a solid, continuous implement (e.g., a pipe, rod, stick, etc.), for anchoring the vessel 102.

Exemplary Guiding Systems

FIGS. 9A-10B illustrate exemplary configurations of the stiffening shaft 100 in a collapsed (i.e., non-rigid) configuration. Such configurations can be used when the trolling motor 104 is not deployed and is being stored on deck or in a cabinet or well on the boat. FIG. 9A shows an embodiment in which the stiffening shaft 100 is folded and FIG. 10A shows an embodiment in which the stiffening shaft 100 is coiled. In some embodiments, the shaft 100 can be configured to be coiled or folded by the application of force exceeding that of the tension element(s) 314. By collapsing into either a folded or coiled configuration, the shaft 100 becomes stowable such that it requires less room on a vessel than its extended configuration (as illustrated in FIG. 8A).

In some embodiments, the shaft 100 can be forced out of its rigid configuration by one or more mechanical guides. In some embodiments, a portion of the shaft 100 can be collapsed (e.g., folded, coiled, etc.), for example, by one or more guides, while the remaining portion of the shaft 100 can remain tensioned. Importantly, the tensioned portion of the shaft 100 can be fully functional and allow power and/or data signals to reach the coupled motor 104. This configuration is advantageous for enabling a stiffening shaft 100 having a given length to be modified for use in varying water depths (or for different applications). Thus, for example, a shaft having a maximum length of 100 inches can be modified to a length less than 100 inches (e.g., 96 inches, 84 inches, etc.). The collapsed portion of the shaft 100, and in some instances the motor 104, may be stored in a housing (e.g., in housing 1002) on board the vessel 102.

In an exemplary embodiment, a guiding system can be used to fold the shaft 100. For example, to fold the stiffening shaft 100 into the shape illustrated in FIG. 9A, the guiding system can include one or more rollers outside the bend (depicted in dashed area 902) of the shaft 100. The guiding system may also include one or more rollers (e.g., arranged in series) along the inside of the bend (depicted in dashed area 904). The guiding system may also include one or more rollers in the interior and/or exterior areas depicted in dashed areas 906 and 908 (see FIG. 9A), respectively.

Figure 9B:
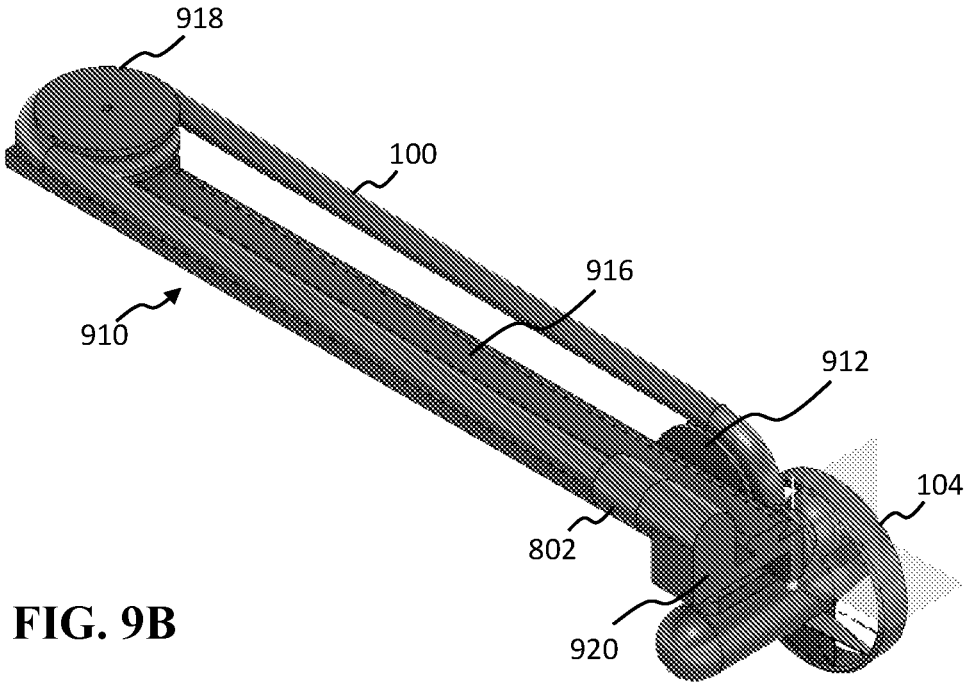
FIG. 9B is a schematic isometric view of the exemplary stiffening shaft of FIG. 9A with an exemplary guiding system.
Figure 9C:
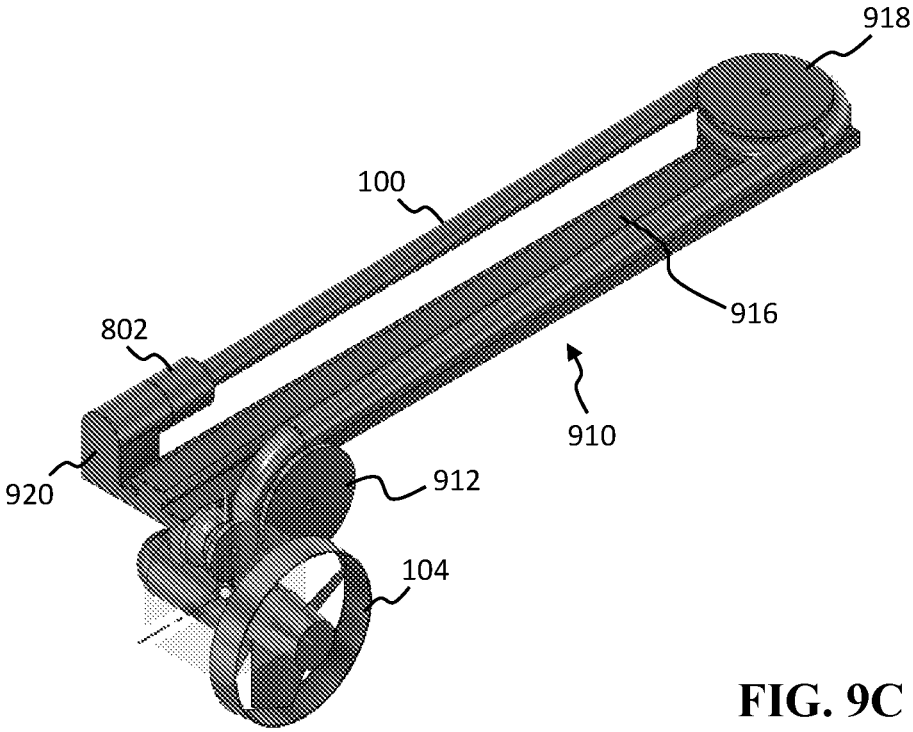
FIG. 9C is a schematic isometric view of the exemplary stiffening shaft of FIG. 9A with the guiding system shown in FIG. 9B.

FIGS. 9B-9C illustrate the exemplary stiffening shaft in the folded configuration of FIG. 9A with an exemplary guiding system 910. The exemplary guiding system 910 can include one or more portions formed to guide certain portions of the shaft 100. The portions can include one or more of: a first roller 912, a longitudinal body 916, a second roller 918, and/or an end portion 920. The rollers 912 and 918 enable the shaft 100 to bend with a radius R. Radius R can be selected such that the bending of the shaft 100 does not harm the structure or function of the shaft 100. The longitudinal body 916 is configured to accommodate the length of the folded shaft 100 and/or enable the guiding system 910 to be mounted to the vessel 102. The end portion 920 is configured to hold (e.g., mechanically, magnetically, etc.) the first end 802 of the shaft 100.

In some embodiments, the shape of the vertebrae is configured to form guide channels for the tension element(s) such that elements remain properly spaced, aligned, and/or supported as the vertebrae distribute around a bend in the shaft 100. When the stiffening shaft 100 is in a deflected position, a subset (e.g., one or two), or portions thereof, of the quasi-spherical concave surfaces of a first vertebra 300*a* are in contact with a corresponding number of quasi-spherical convex surfaces of a second vertebra 300*b* (refer also to FIGS. 4A-4B). This can allow the stacked vertebrae to withstand high compressive loads.

Figure 10A:
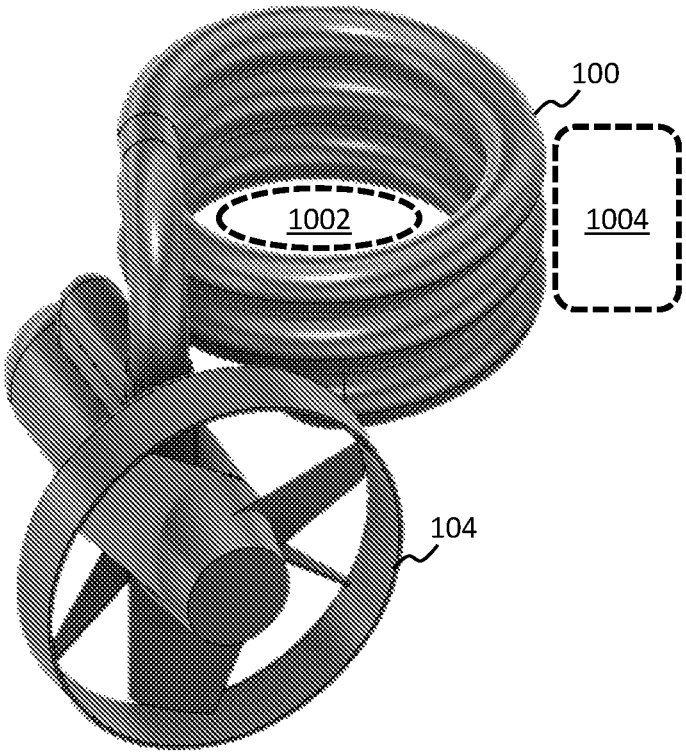
FIG. 10A is a schematic isometric view of an exemplary stiffening shaft in a coiled configuration.

In an exemplary embodiment, a guiding system can be used to coil the shaft 100. For example, as illustrated in FIG. 10A, the guiding system can include rollers positioned interior 1002 and/or exterior 1004 to a coil of the shaft 100 to form it onto a circular or semi-circular shape. In another example, a guiding system can wind the shaft 100 into (or in some cases, about) a drum to force the shaft into a coil shape. In this example, the tension within the tensioning element(s) 314 contribute to the tight winding of the shaft 100 in (or about) the drum. Such a system may include a roller in the drum, positioned at the transition between the coiled portion of the shaft and the stiffened portion of the shaft.

Figure 10B:
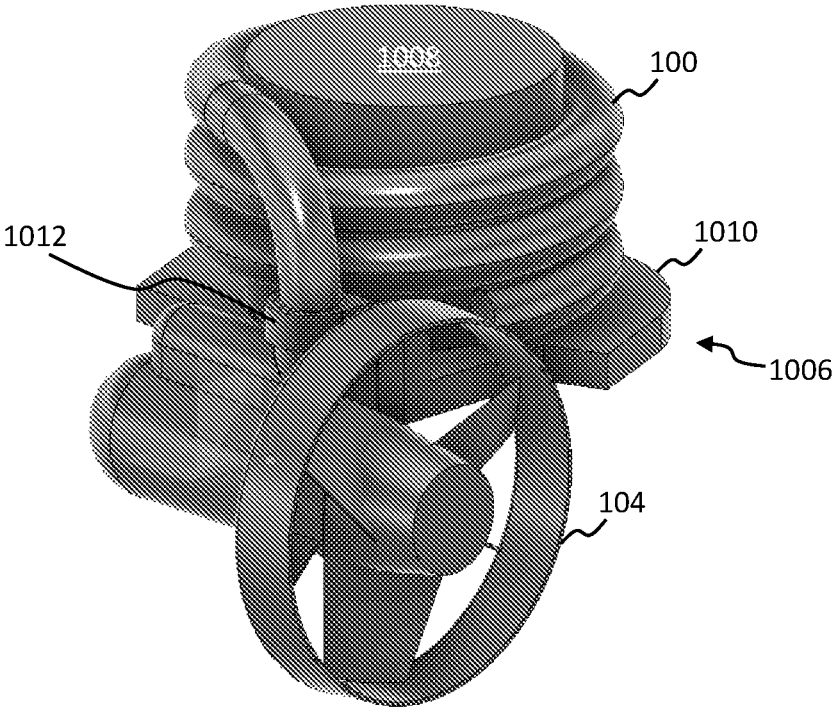
FIG. 10B is a schematic isometric view of the exemplary stiffening shaft of FIG. 10A with an exemplary guiding system.

FIG. 10B illustrates an exemplary guiding system 1006 for a coiled stiffening shaft 100. The guiding system 1006 can include one or more portions to enable the coiling of the shaft 100. The portions can include one or more: a drum 1008, a base 1010, and/or a cylindrical receptacle 1012. The drum 1008 can be configured to accommodate the number of turns in the coiled shaft 100. The base 1010 can be configured to provide stability for the weight of the shaft 100 and/or allow the guide to be mounted to a vessel 102. The receptacle 1012 can be configured to hold the shaft 100 at a fixed point from which the remaining shaft 100 can be coiled. The receptacle 1012 can also be configured to allow the shaft 100 to move in and out of the receptacle 1012 so that the shaft 100 can be easily deployed from the vessel 102.

Exemplary Housings

Figure 11A:
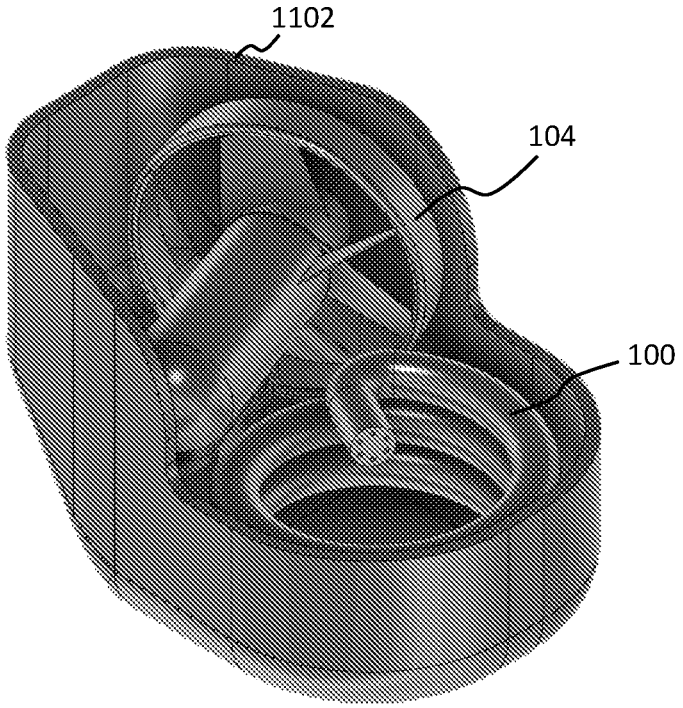
FIG. 11A is a schematic isometric view of the coiled stiffening shaft in an exemplary housing.
Figure 11B:
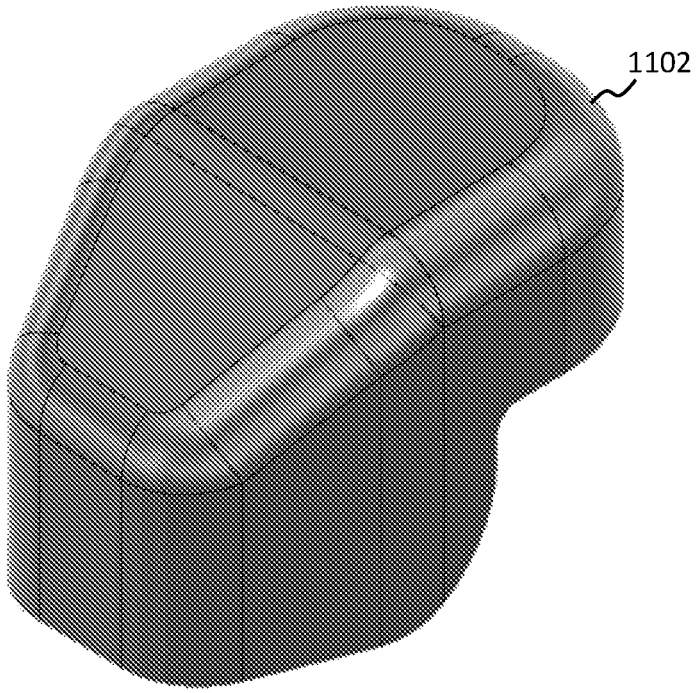
FIG. 11B is a schematic isometric view of the exterior of the exemplary housing.

FIGS. 11A-11B illustrate bottom and top isometric views, respectively, of an exemplary housing 1102 adapted to at least partially contain and/or cover the stiffening shaft 100 and motor 104 in the constrained configuration. In other embodiments, one or more housings can be adapted to contain and/or cover the stiffening shaft 100 or the motor 104 or both the stiffening shaft 100 and the motor 104. The housing 1102 is configured to protect the shaft 100 and/or motor 104 from weather exposure (e.g., sunlight, rain, etc.). The housing 1102 can protect the shaft 100 and/or motor 104 from structural damage due to physical impact.

Exemplary Stiffening Shaft

Figure 12A:
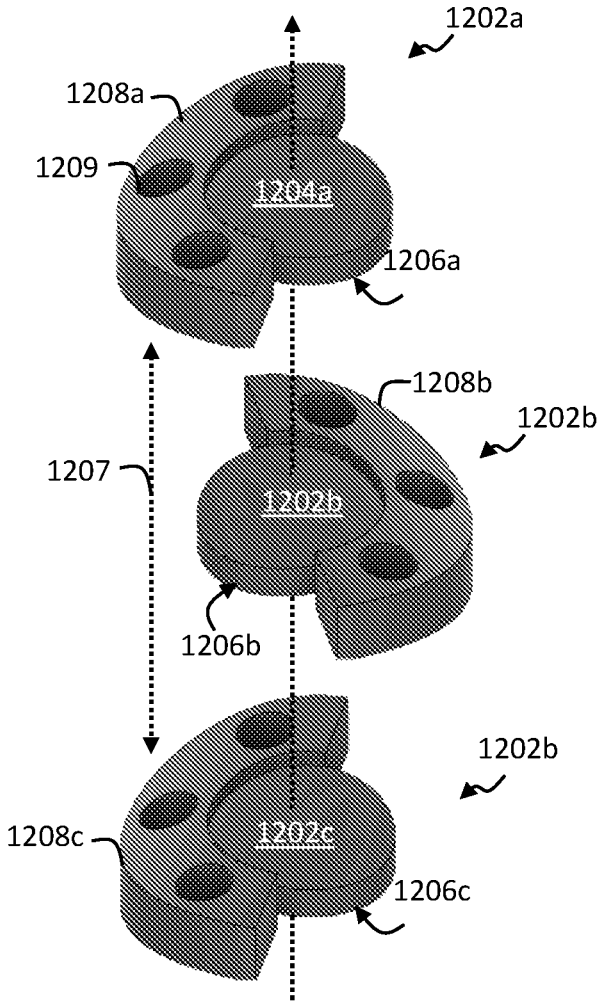
FIGS. 12A-12C are schematic isometric views of zipper segments of a stiffening shaft.
Figure 12B:
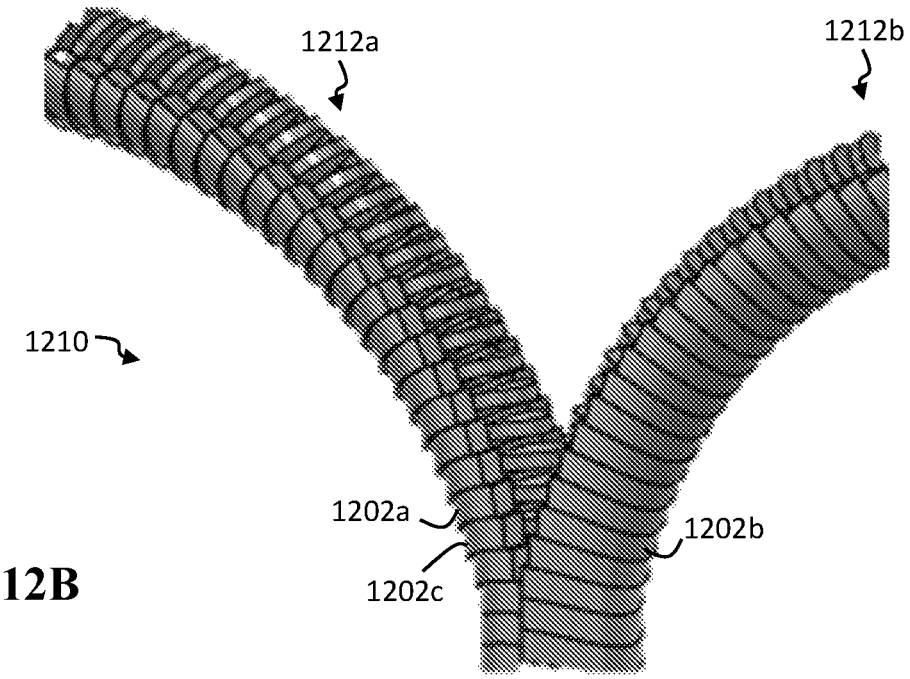
Figure 12C:
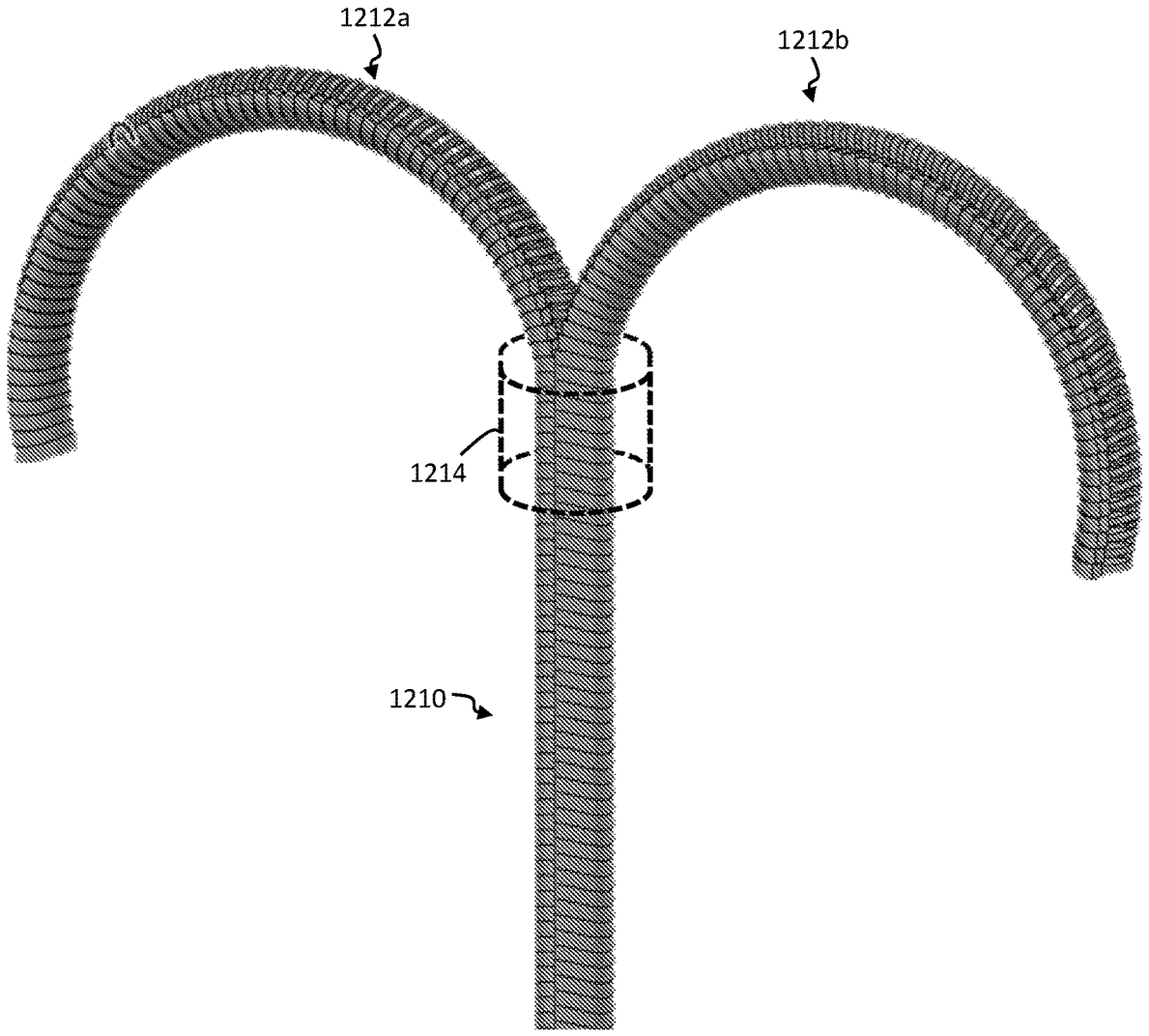

In an exemplary implementation, a stiffening shaft 100 includes a set of zipper segments configured to form a shaft when "zippered" together. As used herein, the term "zippered" means the mating of two segments when brought into contact with each other. As one example, the segments can have corresponding structural features that engage when the segments are brought together, e.g., corresponding teeth interfaces having corresponding hook and loop components. Many other structural elements are possible, including any technique used in known zippers and the exemplary techniques described below. As discussed herein, the zipper segments may be referred to as "vertebrae". FIGS. 12A-12C are diagrams of an exemplary set of zipper segments for the stiffening shaft 100. Each segment 1202*a*-1202*c* (collectively referred to as 1202) can have a first surface 1204*a*-1204*c* (collectively referred to as 1204), respectively, and second surface 1206*a*-1206*c* (collectively referred to as 1206), respectively. Each first surface 1204 is configured to mate with the second surface 1206. For example, the first surface 1202*b* is configured to mate with the second surface 1206*a*. The segments 1202 can be arranged such that the surfaces 1204, 1206 align in an interleaving or interweaving manner. The surfaces 1204, 1206 can take various shapes (circular, rectangular, polygonal, etc.). In this example, the surfaces 1204, 1206 are in a circular shape. In some embodiments, the segments 1202 includes an outer portion 1208*a*-1208*c* (collectively referred to as 1208) that may not necessarily stack with an immediate segment. For example, when the surfaces 1202, 1204 of segments 1202*a*, 1202*b*, and 1202*c* are aligned, the outer portion 1208*a* of segment 1202*a* stacks (according to line 1207) with the outer portion 1208*c* of segment 1202*c*. Therefore, in this exemplary implementation, the outer portion of every other segment is stacked. In some implementations, the segments 1202 can be made of one or more materials, e.g., high compressive load material (e.g., fiber-reinforced composite, metal, ceramic, etc.).

In some implementations, the segments 1202 can include one or more holes 1209 for tension elements (e.g., cables) as described above. For example, the outer portions 1208 of segments 1202 can include the hole(s) 1209. The tension elements may be made of high tensile strength material(s) (e.g., ultra-high-molecular-weight polyethylene (UHMWPE or UHMW) fiber, carbon fiber, aromatic polyamide (aramid) fiber, etc.). In some implementations, the stiffening shaft may utilize passive tensioning, in which the interleaving or interlocking of the segment set 1212*a* with set 1212*b* can cause the tension elements to tense as the shaft 1210 is zipped together, as described further below. Alternatively or additionally, the tension elements may be actively tensioned to achieve rigidity, as described further above (see description under heading "Exemplary Tensioning Systems").

FIGS. 12B-12C illustrate the stacking or "zippering" of segments 1202 into a shaft. For the purposes of illustration, segments 1202*a*, 1202*b*, 1202*c* are identified in the shaft 1210 as it is being assembled. As discussed herein, a set of segments 1202 may be referred to as a "strand" of segments 1202 such that a stiffening shaft can include two or more strands (e.g., first strand 1212*a* and second strand 1212*b*). In general, any number of strands can be used, e.g., 2, 3, 4, 5, 6, 8, or 10. In instances in which more than two strands are used, the strands can be structurally modified to accommodate the joining of additional elements. The shaft 1210 may be assembled when a first set 1212*a* of segments are brought together with a second set 1212*b* of segments. As depicted, the segments 1202 may be considered to be part of a "left strand" or a "left zipper" or a "right strand" or a "right zipper". As the two sets 1212*a*, 1212*b* of segments are brought together, the segments 1202 interleave as described above to form a single shaft 1210. In some implementations, the shaft 1210 becomes rigid as the segments interleave.

In some implementations, the assembly or formation of the shaft 1210 may be aided by a guide 1214. The guide 1214 may have any type of a shape to facilitate zippering of the segment sets 1212*a*, 1211*b*. The shape of the 1214 may be determined by the shape of the segments 1202 themselves. For example, the guide 1214 may have a funnel shape, a cylindrical shape, a rectangular shape, a traditional zipper tab or slider shape, etc. In some cases, the guide 1214 may be moved along the segment sets 1212*a* and 1212*b* to "zipper" them together. Alternatively, the segment sets 1212*a*, 1212*b* can be moved into the guide 1214 to zipper. In some implementations, the guide 1214 may be configured to be a housing and/or storage vessel for the unzipped sets 1212*a*, 1212*b*. In some cases, the unzipped sets 1212*a*, 1212*b* may be stored as coils. In some implementations, each set 1212*a* or 1212*b* alone can be wound into a tighter coil as compared to the assembled shaft 1210.

Exemplary Parameters for Stiffening Shafts

The exemplary stiffening shafts and components thereof described herein may be characterized by one or more of the parameters listed in FIG. 13. FIG. 13 is a chart including example parameters related to the stiffening shaft. Each numerical value presented herein is contemplated to represent a minimum value or a maximum value in a range for a corresponding parameter. Accordingly, when added to the claims, the numerical value provides express support for claiming the range, which may lie above or below the numerical value, in accordance with the teachings herein. Every value between the minimum value and the maximum value within each numerical range presented herein (including the low, nominal, and high values shown in the chart shown in FIG. 13), is contemplated and expressly supported herein, subject to the number of significant digits expressed in each particular range. The parameter values in the chart of FIG. 13 are intended to be non-limiting examples. In other embodiments, values below and above the minimum ("low") and/or maximum ("high") values are contemplated.

Terminology

The phraseology and terminology used herein is for the purpose of description and should not be regarded as limiting.

The term "approximately", the phrase "approximately equal to", and other similar phrases, as used in the specification and the claims (e.g., "X has a value of approximately Y" or "X is approximately equal to Y"), should be understood to mean that one value (X) is within a predetermined range of another value (Y). The predetermined range may be plus or minus 20%, 10%, 5%, 3%, 1%, 0.1%, or less than 0.1%, unless otherwise indicated.

The indefinite articles "a" and "an," as used in the specification and in the claims, unless clearly indicated to the contrary, should be understood to mean "at least one." The phrase "and/or," as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The use of "including," "comprising," "having," "containing," "involving," and variations thereof, is meant to encompass the items listed thereafter and additional items.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements. Each numerical value presented herein is contemplated to represent a minimum value or a maximum value in a range for a corresponding parameter. Accordingly, when added to the claims, the numerical value provides express support for claiming the range, which may lie above or below the numerical value, in accordance with the teachings herein. Every value between the minimum value and the maximum value within each numerical range presented herein (including in any charts), is contemplated and expressly supported herein, subject to the number of significant digits expressed in each particular range. Absent express inclusion in the claims, each numerical value presented herein is not to be considered limiting in any regard. Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive. The terms and expressions employed herein are used as terms and expressions of description and not of limitation and there is no intention, in the use of such terms and expressions, of excluding any equivalents of the features shown and described or portions thereof. The structural features and functions of the various embodiments may be arranged in various combinations and permutations, and all are considered to be within the scope of the disclosed invention. Unless otherwise necessitated, recited steps in the various methods may be performed in any order and certain steps may be performed substantially simultaneously.

What is claimed is:

1. A stiffening shaft adapted to couple to a marine vessel, the stiffening shaft comprising:

a plurality of vertebrae stacked to form a column;

at least one inelastic tension element threaded longitudinally through the plurality of vertebrae to link the plurality of vertebrae, wherein at least a portion of the stiffening shaft has a flexible configuration when the at least one inelastic tension element is released and a stiffened linear configuration when the at least one inelastic tension element is tensed to react to torque and bending moments on the stiffening shaft; and a tensioning system adapted to selectively tense the at least one inelastic tension element to transition the stiffening shaft between the flexible configuration and the stiffened linear configuration.

2. The stiffening shaft of claim 1, wherein, when the stiffening shaft transitions from the flexible configuration to the stiffened linear configuration, a first vertebra of the plurality of vertebrae attains concentric alignment with a second vertebra of the plurality of vertebrae.

3. The stiffening shaft of claim 2, wherein the first vertebra comprises a first contoured mating surface and the second vertebra comprises a second contoured mating surface, such that, the first contoured mating surface mates with the second contoured mating surface to attain concentric alignment.

4. The stiffening shaft of claim 1, wherein each vertebra of the plurality of vertebrae has an annular shape.

5. The stiffening shaft of claim 4, wherein the first contoured mating surface comprises a plurality of concave surfaces arranged about a perimeter of the annular shape, and the second contoured mating surface comprises a plurality of convex surfaces arranged about the perimeter of the annular shape, wherein the plurality of concave surfaces and the plurality of convex surfaces are adapted to mate to form a joint about which the first vertebra and the second vertebra can flex.

6. The stiffening shaft of claim 5, wherein at least one joint forms a hole extending from the first contoured mating surface to the second contoured mating surface, wherein the hole is adapted to accept one of the at least one inelastic tension element.

7. The stiffening shaft of claim 1, wherein the at least one inelastic tension element comprises at least two inelastic tension elements, each inelastic tension element displaced from a center of the stiffening shaft.

8. The stiffening shaft of claim 1, further comprising a motor disposed at a distal end thereof, wherein the stiffening shaft is adapted to at least partially house a control cable coupled to the motor.

9. The stiffening shaft of claim 8, wherein the stiffening shaft is further adapted to at least partially house a power cable adapted to couple a power source with the motor.

10. The stiffening shaft of claim 1, wherein the tensioning system is adapted to limit tension when an external force exceeding a load capacity of the stiffening shaft is applied to the stiffening shaft when the stiffening shaft is in the stiffened linear configuration.

11. The stiffening shaft of claim 1, wherein the plurality of vertebrae include a first set of vertebrae and a second set of vertebrae, the first set of vertebrae separate from the second set of vertebrae, and wherein the first set of vertebrae and the second set of vertebrae zipper together to form the stiffening shaft.

12. The stiffening shaft of claim 11, wherein a first inelastic tension element of the at least one inelastic tension element is threaded through the first set of vertebrae and a second inelastic tension element is threaded through the second set of vertebrae.

13. The stiffening shaft of claim 1, wherein the stiffening shaft is configured to transition to a coil configuration when in the flexible configuration.

14. A method of manufacturing a stiffening shaft, the method comprising the steps of:

providing a plurality of vertebrae stacked to form a column;

threading at least one inelastic tension element through the plurality of vertebrae to link the plurality of vertebrae, wherein at least a portion of the stiffening shaft has a flexible configuration when the at least one inelastic tension element is released and a stiffened linear configuration when the at least one inelastic tension element is tensed to react to torque and bending moments on the stiffening shaft; and attaching the at least one tension element to a tensioning system, wherein the tensioning system is adapted to selectively tense the at least one inelastic tension element to transition the at least a portion of the stiffening shaft between the flexible configuration and the stiffened linear configuration.

15. The method of claim 14, further comprising:

attaching a motor to an end of a column formed by the linked plurality of vertebrae.

16. The method of claim 14, wherein each vertebra of the plurality of vertebrae comprises a first contoured mating surface and a second contoured mating surface, such that, the first contoured mating surface of a first vertebra of the plurality of vertebrae mates with the second contoured mating surface of a second vertebra of the plurality of vertebrae to attain concentric alignment.

17. The method of claim 16, wherein each vertebra of the plurality of vertebrae has an annular shape.

18. The method of claim 17, wherein the first contoured mating surface comprises a plurality of concave surfaces arranged about a perimeter of the annular shape, and the second contoured mating surface comprises a plurality of convex surfaces arranged about the perimeter of the annular shape, wherein the plurality of concave surfaces and the plurality of convex surfaces are adapted to mate to form a joint about which the first vertebra and the second vertebra can flex.

19. The method of claim 18, wherein at least one joint forms a hole extending from the first contoured mating surface to the second contoured mating surface, wherein the hole is adapted to accept one of the at least one tension element.

20. The method of claim 14, wherein the at least one tension element comprises at least two tension elements, each tension element displaced from a center of the stiffening shaft.

* * * * *